United States Patent [19]

Röhss

[11] 4,001,992

[45] Jan. 11, 1977

[54] REINFORCEMENT MEANS

[75] Inventor: Eric Röhss, Askim, Sweden

[73] Assignee: Ola Bergqvist AB, Vastra Frolunda, Sweden

[22] Filed: Mar. 20, 1975

[21] Appl. No.: 560,296

[52] U.S. Cl. ..... 52/251; 52/741

[51] Int. Cl.[2] ..... E04B 1/00

[58] Field of Search ..... 52/105, 110, 250, 251, 52/252, 253, 258, 259, 741, 743, 749; 264/35; 343/715; 404/70, 82, 93, 100

[56] References Cited

UNITED STATES PATENTS

| | | | |
|---|---|---|---|
| 1,036,384 | 8/1912 | Turner | 52/251 |
| 1,064,850 | 6/1913 | Morrow | 52/251 |
| 1,166,642 | 1/1916 | Sprol | 52/253 |
| 2,666,546 | 1/1954 | Reilly | 52/105 |
| 2,811,330 | 10/1957 | Demunter | 343/715 |
| 3,086,273 | 4/1963 | Welborn | 52/223 R |
| 3,354,593 | 11/1967 | Zukas | 52/251 |
| 3,587,198 | 6/1971 | Hensel | 264/35 |
| 3,613,325 | 10/1971 | Yee | 52/251 |

OTHER PUBLICATIONS

Reinforced Concrete and Masonry Structures 2nd Edition; 1944; McGraw-Hill & Co; by George A. Hool; W. S. Kline, pp. 306–307.

*Primary Examiner*—2
*Assistant Examiner*—Carl D. Friedman
*Attorney, Agent, or Firm*—Harness, Dickey & Pierce

[57] ABSTRACT

A concrete reinforcement means arranged in cast walls particularly but not exclusively for the purpose of supporting the wall during casting of the superposed wall, the upper ends of said means projecting vertically to a level past the plane of the predetermined surface of the joisting slab to be cast on top of the first wall. The reinforcement means are sufficiently pliant to bend down level with the joisting slab surface and capable of springing back to their original position, whereby any tool necessary for the finishing treatment of the concrete joisting slab may work on the entire slab surface in a quick and efficient manner without being impeded by the upright ends of said reinforcement means.

4 Claims, No Drawings

REINFORCEMENT MEANS

BACKGROUND OF THE INVENTION

The present invention concerns a means of reinforcing concrete. More particularly, the invention concerns a reinforcement means which is arranged to extend upwards from the upper face of a cast wall past the predetermined surface of the joisting slab to be cast on top of the wall. The reinforcement means is primarily intended to serve as a so called safety reinforcement for the wall to be subsequently cast on top of the first-mentioned wall in order to eliminate the risk of collapse of the wall below.

In accordance with conventional techniques rigid reinforcement rods are used which thus project somewhat upwards above the cast slab forming the floor joisting. These projecting ends of the reinforcement rods are a hindrance in several respects. In the surface treatment of the joisting slab such as vibration, scouring and smoothing, the rod ends are in the way. For example, a vibro tube which has the form of an elongate body which normally extends across the entire slab, must be lifted over the rod ends, one man lifting each end of the vibro tube, which is a demanding task. Because of the rod ends it is not either possible to satisfactorily treat the marginal areas on either side of the row of reinforcement rods. In addition, this row of reinforcement rods on the whole hampers the building worker in his job and constitutes a constant risk of injury to the worker in that he easily gets caught by a rod or trips and falls against the rigid rod ends.

For this reason the elimination of the risks and inconveniences involved with the projecting rigid reinforcement rod ends has been urgent. In accordance with one solution a novel reinforcement method has been developed. In accordance with this method the reinforcement rods which project upwards from a cast wall are allowed to project only up to a height which is somewhat below the predetermined level of the joisting slab to be cast on top of said wall. Onto the free ends of the reinforcement rods are then threaded a block of cellular plastics, preferably Frigolit. The joisting slab is then cast, whereby the block of cellular plastics will be enclosed in the cast slab. However, care is taken that the upper surface of the blocks will be essentially level with the upper surface of the slab. As in this case there will be no projecting ends the surface treatment of the slab may be performed in a much more rapid and safer way while at the same time the entire surface of the slab will be treated with equally good results. When the treatment of the slab is finished, the blocks of cellular plastics are dissolved with the use of washing thinner, whereby a cavity is formed in the slab about the rod ends which thus are exposed. A conical sleeve of a special design is threaded onto one end of a loose reinforcement rod and together they are threaded onto an exposed rod end in the slab, whereupon the conical sleeve is hammered on by means of a tool so as to wedge the rod ends securely inside the sleeve. A secure joint between two reinforcement rods in two separate walls is thus formed.

Although the method described above provides the advantages outlined in the aforegoing in facilitating the surface treatment of the joisting slab it still envolves several complications. The reinforcement work becomes involved and complicated on account of the numerous working operations, which means loss of time. In order to achieve a strong joint between the reinforcement rods in separate floors it is necessary that the jointing be performed with great care. This is not always done in practice where rapidity of work often prevails over exactness. Bad execution of the reinforcement joints means that the reinforcement as a whole becomes inferior.

SUMMARY OF THE INVENTION

The purpose of the present invention is to eliminate by very simple means the drawbacks in prior-art reinforcement methods as outlined above. As mentioned initially, the invention is based on the principle that an end portion of the reinforcement means which is enclosed in the cast wall element is allowed to project up over the latter, said end portion intended to be enclosed in the subsequent wall element which is cast on top of the first one. It is characteristic of the present invention that the reinforcement means is formed by a steel rope or wire or by a bundle of threads and that it is easily pliable and springs back when bent downwards. Through this simple improvement considerable advantages are obtained. There is no need to lift heavy tools or elements, such as a vibro tube, above the projecting ends of the steel wire but the tool may simply be dragged over them as the wire ends gently and flexibly bend down and then spring back again. The invention thus provides a possibility of utilizing the advantages both of the reinforcement method using conventional reinforcement rods, i.e. rigid bridging joints between two wall elements with ensuing simplicity of procedure, as well as those of the jointing sleeve method providing simplicity of surface treatment of a joisting slab just cast while at the same time the method in accordance with the present invention eliminates all the disadvantages inherent in the prior-art methods.

BRIEF DESCRIPTION OF THE DRAWINGS

Further characteristics of the invention and the advantages obtained thereby will become apparent upon reading of the following description with reference to the accompanying drawings, wherein.

DETAILED DESCRIPTION OF A PREFERRED EMBODIMENT

Figure 1:
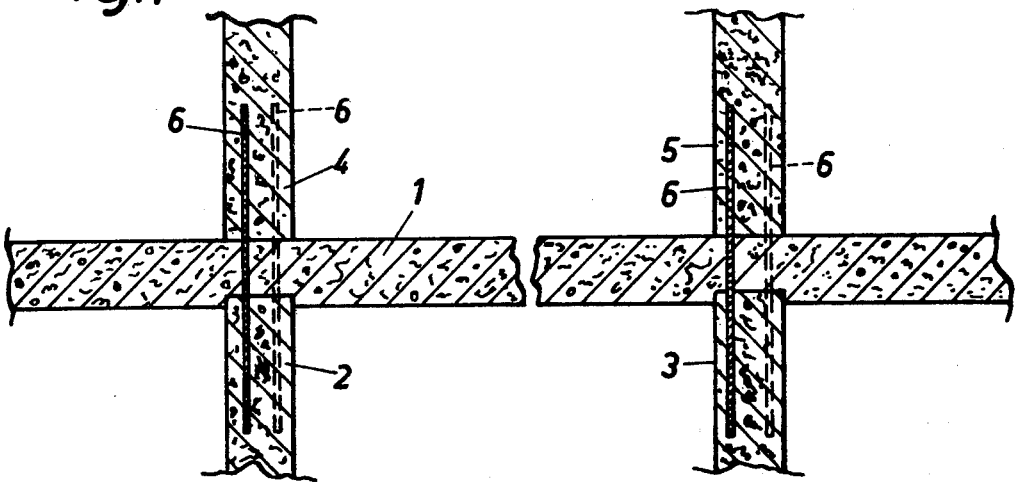
FIG. 1 is a vertical cross-sectional view through a floor joisting layer including a reinforcement means in accordance with the present invention.

FIG. 1 illustrates a floor joisting layer 1, the upper portionof a pair of walls 2, 3 of a floor and the lower portion of a pair of walls 4, 5 of the floor positioned above. Into the walls 2 and 3 are cast reinforcement steel wires 6 in accordance with the invention. These wires extend up through the joisting slab 1 into the walls 4 and 5, respectively, so as to form a safety reinforcement means to these walls for the purpose of eliminating the risk of their collapsing before the following joisting slab is cast.

Figure 2:
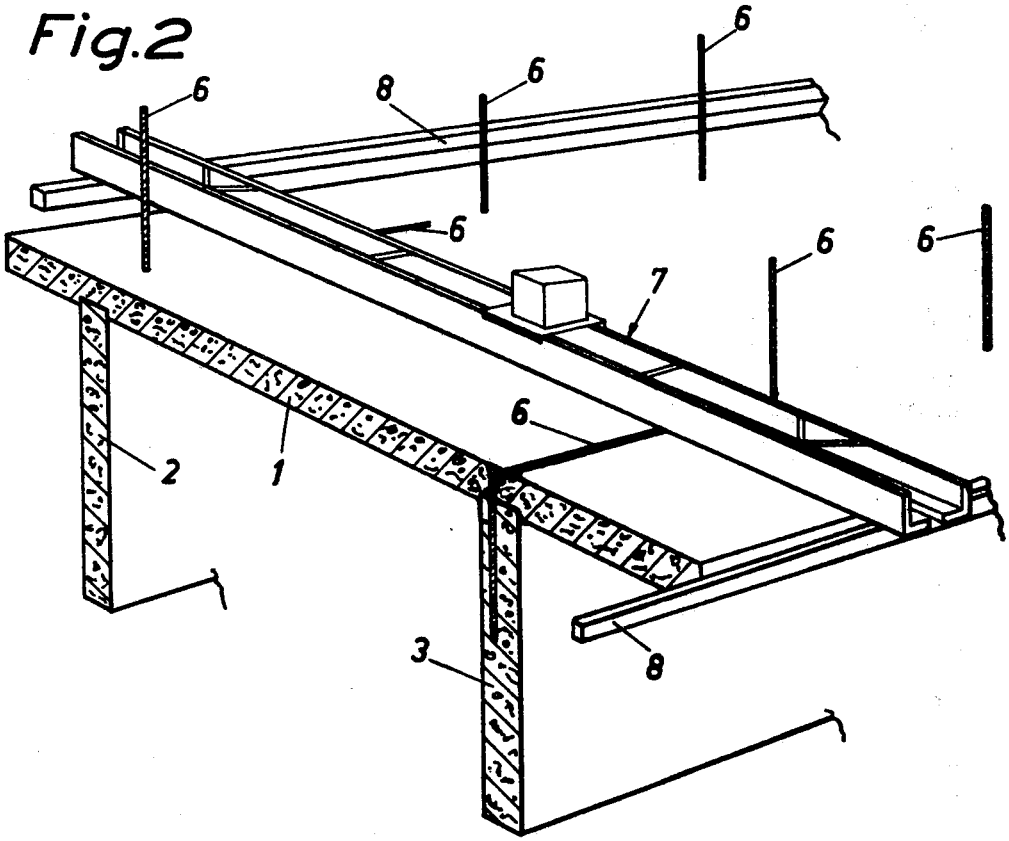
FIG. 2 is a perspective view of a floor joisting layer while being surface treated.

FIG. 2 illustrates the manner in which the invention is utilized. The walls 2 and 3 are completed, having the reinforcement steel wires 6 cast therein. The joisting slab 1 is imagined to have just been cast. Above it is arranged a surface treatment tool 7 which is imagined to be a vibro tube resting on longitudinal rails 8. Without impediment the tool may be run over the entire surface of the slab 1 as a consequence of the ability of the steel wires 6 to bend pliantly when the tool runs into contact with them. Behind the tool 7 as seen in the direction of movement the wires 6 spring back into vertical position.

Figure 3:
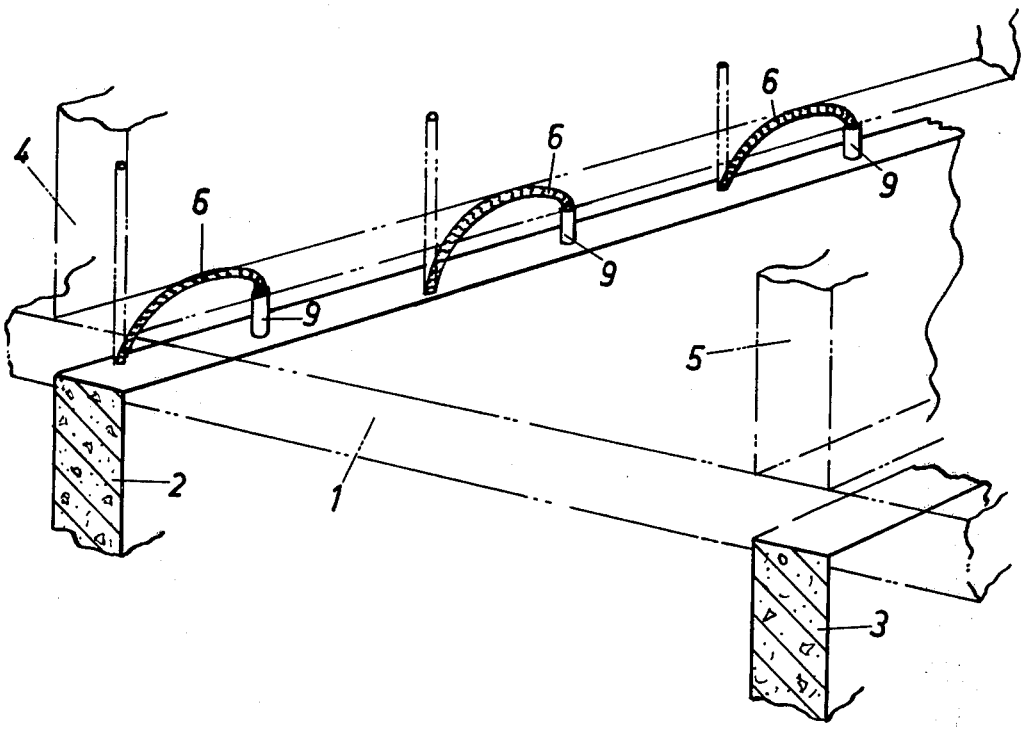
FIG. 3 is a perspective view of a special embodiment of the invention.

FIG. 3 illustrates an embodiment of the invention which is preferred when use is made of steel wires 6 or, as a possible alternative, of bundles or threads that are coarser than normally and therefore less pliant or when the joisting slab is to be treated by means of tools that are so lightweight that the steel wires or bundle of threads, despite their pliability, offer a certain resistance against bending. In these cases tubes 9 are cast between the reinforcement means 6 in a vertical position in the upper face of a wall 2, into which tubes the ends of the reinforcement means may be inserted sufficiently deep for the reinforcement means to extend in a curve which essentially is a tangent to the predetermined surface of the joisting slab 1 to be cast subsequently. The surface treatment of this slab may thereafter be performed without impediment and in a following step the reinforcement means 6 may be retracted individually from their respective tube 9 and be allowed to spring back to vertical position and be enclosed in the subsequent wall 4 during casting of the latter.

The invention is not limited to the embodiments as shown and described but may be varied in a variety of ways within the scope of the appended claims. Instead of inserting the reinforcement means ends into tubes 9 it is possible to enclose them in a cover which does not adhere to concrete, and thereafter cast the ends into the joisting slab 1. When the treatment of the latter is completed the ends may again be withdrawn from the slab and the reinforcement means 6 allowed to spring back into vertical position, whereupon the covers are removed.

The reinforcements in accordance with the invention need not serve only as safety reinforcement means but may also be used as a static reinforcement means, i.e. as a means absorbing stresses occuring in the structure. Consequently, no further reinforcement is required.

What I claim is:

1. An improved means for reinforcing concrete and to prevent collapse of concrete walls during the forming thereof comprising a complete cast wall having reinforcement means cast therein, and a joisting slab cast above and supported at least in part by said complete cast wall, said reinforcement means extending through said joisting slab and extending a sufficient distance thereabove to be cast into another wall supported at least in part upon said joisting slab, said reinforcement means comprising a steel wire, said wire having resilience on the portion thereof extending above said joisting slab, said resilience being of an order so that the portion of the wire may be readily deformed to a substantially level condition with the upper surface of said joisting slab during finishing operations thereupon and capable of springing back by its own resilience to its upstanding position for casting into the other wall.

2. The reinforcement means as claimed in claim 1 wherein the steel wire comprises a bundle of threaded wires.

3. The reinforcement means as claimed in claim 2 further including a tube cast into the upper face of the cast wall and extending through the joisting slab, said tube being positioned laterally of said reinforcement means and parallel thereto and adapted to receive the end of said reinforcement means.

4. The method of forming a reinforced concrete structure for preventing collapse of concrete walls thereof during forming comprising the steps of casting a vertical wall having reinforcing means therein with the reinforcing means extending upwardly past the upper surface of the wall, casting a joisting slab upon the wall and around the reinforcing means, and forming at least a portion of the reinforcing means extending above the joisting slab with resilience of an order to permit the reinforcing means to be deformed to a substantially level condition with the upper surface of the joisting slab during finishing operations thereupon and capable of springing back by its own resilience to its upstanding position for casting into another wall supported at least in part upon the joisting slab.

* * * * *